US008122965B2

(12) United States Patent
Horton, III et al.

(10) Patent No.: US 8,122,965 B2
(45) Date of Patent: Feb. 28, 2012

(54) METHODS FOR DEVELOPMENT OF AN OFFSHORE OIL AND GAS FIELD

(75) Inventors: Edward E. Horton, III, Houston, TX (US); James V. Maher, Houston, TX (US)

(73) Assignee: Horton Wison Deepwater, Inc., Houston, TX (US)

( * ) Notice: Subject to any disclaimer, the term of this patent is extended or adjusted under 35 U.S.C. 154(b) by 1158 days.

(21) Appl. No.: 11/754,851

(22) Filed: May 29, 2007

(65) Prior Publication Data

US 2008/0135233 A1 Jun. 12, 2008

Related U.S. Application Data

(60) Provisional application No. 60/869,173, filed on Dec. 8, 2006.

(51) Int. Cl.
*E21B 43/01* (2006.01)

(52) U.S. Cl. ..... 166/366; 166/336; 166/352; 166/369

(58) Field of Classification Search ..... 166/366, 166/336, 344, 345, 351–354, 358, 367, 368, 166/369; 441/3; 175/5, 7; 405/195.1, 223.1, 405/224; 114/264–266, 230.1
See application file for complete search history.

(56) References Cited

U.S. PATENT DOCUMENTS 3,063,507 A * 11/1962 O'Neill et al. ..... 175/8
3,219,118 A * 11/1965 Lewis ..... 166/351
3,575,005 A * 4/1971 Sumner ..... 405/196
4,511,287 A * 4/1985 Horton ..... 405/204
4,604,961 A * 8/1986 Ortloff et al. ..... 114/230.12
4,666,340 A * 5/1987 Cox ..... 405/204
4,819,730 A * 4/1989 Williford et al. ..... 166/355
4,972,907 A * 11/1990 Sellars, Jr. ..... 166/353
5,190,411 A * 3/1993 Huete et al. ..... 405/223.1
5,259,456 A * 11/1993 Edwards et al. ..... 166/319
5,486,070 A * 1/1996 Huete ..... 405/202
5,662,170 A * 9/1997 Donovan et al. ..... 166/358
6,047,781 A * 4/2000 Scott et al. ..... 175/5
6,056,071 A * 5/2000 Scott et al. ..... 175/5
6,068,069 A * 5/2000 Scott et al. ..... 175/5
6,085,851 A * 7/2000 Scott et al. ..... 175/7
6,199,500 B1 * 3/2001 B.o slashed.rseth et al. ..... 114/230.12
6,203,247 B1 * 3/2001 Schellstede et al. ..... 405/196
6,213,215 B1 * 4/2001 Breivik et al. ..... 166/350
6,453,838 B1 * 9/2002 Mowell et al. ..... 114/230.13
6,494,271 B2 * 12/2002 Wilson ..... 175/5
6,968,795 B2 * 11/2005 Lambregts et al. ..... 114/65 R
6,968,902 B2 * 11/2005 Fenton et al. ..... 166/358
(Continued)

OTHER PUBLICATIONS

International Search Report and Written Opinion for PCT/US2007/086738 dated Apr. 14, 2008 (10 pages).

*Primary Examiner* — Thomas Beach
*Assistant Examiner* — Matthew Buck
(74) *Attorney, Agent, or Firm* — Conley Rose, P.C.

(57) ABSTRACT

Methods for developing an offshore field comprising deploying a lead drilling and production vessel to a offshore field to drill and complete at least one well. Production from the at least one well is initiated and evaluated. A secondary production vessel is selected based upon the evaluated production and is deployed to the offshore field to replace the lead drilling and production vessel and support production of the at least one well.

33 Claims, 18 Drawing Sheets

U.S. PATENT DOCUMENTS 6,980,940 B1 * 12/2005 Gurpinar et al. ..... 703/10
7,073,593 B2 * 7/2006 Hatton et al. ..... 166/367
7,434,624 B2 * 10/2008 Wilson ..... 166/368
7,478,024 B2 * 1/2009 Gurpinar et al. ..... 703/10
7,512,543 B2 * 3/2009 Raghuraman et al. ..... 705/7
7,628,224 B2 * 12/2009 D'Souza et al. ..... 175/5
2004/0238176 A1 * 12/2004 Appleford et al. ..... 166/353
2005/0121230 A1 * 6/2005 Baek et al. ..... 175/5
2006/0157275 A1 * 7/2006 Kadaster et al. ..... 175/5
2006/0177273 A1 * 8/2006 Bonnemaire et al. ..... 405/211
2007/0044972 A1 * 3/2007 Roveri et al. ..... 166/367

* cited by examiner

190

METHODS FOR DEVELOPMENT OF AN OFFSHORE OIL AND GAS FIELD

CROSS-REFERENCE TO RELATED APPLICATIONS

This application claims priority to U.S. Provisional Patent Application No. 60/869,173, filed Dec. 8, 2006, and titled Methods for Development of an Offshore Oil and Gas Field, which is hereby incorporated by reference herein in its entirety for all purposes.

STATEMENT REGARDING FEDERALLY SPONSORED RESEARCH OR DEVELOPMENT

Not Applicable.

BACKGROUND OF THE INVENTION

The invention relates to methods for developing offshore oil and gas fields. One of the biggest challenges in the development of oil and gas fields has been the fact that the reservoirs found in the fields can not be observed except through indirect means, which introduce a large amount of conjecture in the assessment of the actual in-place conditions. In deepwater offshore fields, conventional methods used to mitigate risks in the development have proven problematic, forcing a development regime where the investments are much larger and yet have to be made with less information than is traditionally collected prior to decision making.

Investments involved in the development of oil and gas fields are substantial and subject to high levels of risks. The development of an oil and gas field has generally involved significant up-front data gathering, in order to estimate the risks involved in the project, and engineering, in order to better specify the final delivered product and therefore the costs involved. The process for bringing a field into production involves a number of sequential definitional steps.

Although each company has small variations, the steps involved in the typical development processes 10, which are shown in FIG. 1 and include geological exploration of a field 12, appraisal drilling of wells within the field 14, defining the plan for the development of the field 16, executing the plan 18, and operating the field 19. The geological exploration of a field 12 comprises various preliminary geological investigations and sparse 2D seismic work followed by a 3D seismic survey. If a prospect looks promising an exploration well is drilled. During this process, various reservoir models are generated from the seismic and then updated with information checked against the well results.

Once the initial exploration well has been drilled and some quantity of hydrocarbons has been identified, the appraisal drilling phase 14 starts. In this phase, several additional wells are drilled to delineate the reservoir and gain reservoir information. As the wells are drilled, various logging and testing operations can be performed in order to establish reasonable information to put into the reservoir models, which are then used for better understanding of the various important parameters.

Once the reservoir has been appraised, a plan for development of the field is defined 16. The plan may comprise identification as to the number and location of wells to be drilled, what kind of surface facilities, what type of riser systems, and what export means (pipelines, tankers, etc.) will be used. These plans are all based on the reservoir information that is available, which as discussed above, may be incomplete or inaccurate. Once defined, the plan for development is executed 18, which comprises the procurement and construction of equipment and systems needed for the project. Once the necessary equipment is in place, the field can be operated 19.

During the operation of the field 19, conditions within the field may change or may not be exactly what was predicted during the evaluation and planning phases. Because most of the equipment and systems specified for the field were designed and built to operate under a specific set of conditions, any change to these conditions may cause the equipment to operate at less than optimal efficiency.

Although the processes and their associated faults discussed above are generally used for all fields regardless of location or technical complexity, there are a number of additional factors in the high pressure, high temperature, sub salt portion of the deepwater Gulf of Mexico that make these processes particularly problematic. One of these factors is that, in the deepwater Gulf of Mexico, the seismic technologies are significantly less reliable due to the extreme depths of the targets combined with the complications involved in seismic data acquisition through the salt canopy that covers much of the acreage in the deepwater Gulf of Mexico. Deficiencies in the seismic exploration are often made up for by drilling more exploration wells, but this is not an attractive option because the costs and complexity of drilling a well in these deepwater regions are significant.

Thus, the embodiments of the present invention are directed to methods for developing offshore fields that seek to overcome these and other limitations of the prior art.

SUMMARY OF THE PREFERRED EMBODIMENTS

In one embodiment, the method of the present invention comprises deploying a lead drilling and production vessel to an offshore field to drill and complete at least one well. Production from the at least one well is initiated and evaluated. A secondary production vessel is selected based upon the evaluated production and is deployed to the offshore field to replace the lead drilling and production vessel and support production of the at least one well.

Thus, the embodiments of present invention comprise a combination of features and advantages that enable the development of an offshore field to be performed in a more flexible and economical manner. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed understanding of the present invention, reference is made to the accompanying Figures, wherein.

DETAILED DESCRIPTION OF THE PREFERRED EMBODIMENTS

Figure 1:
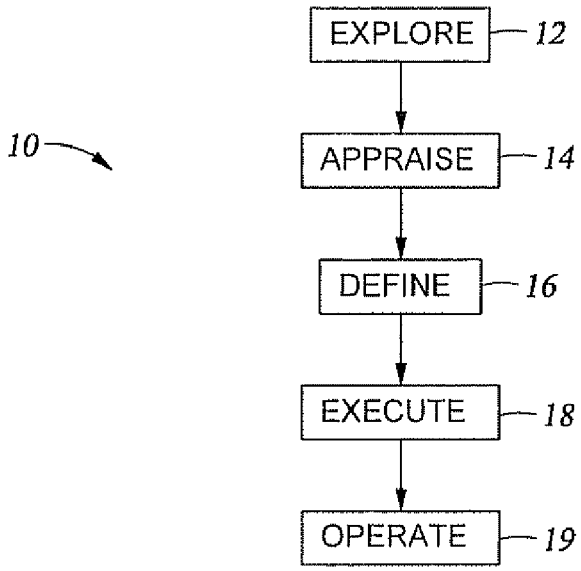
Fig. 1 (PRIOR ART)
FIG. 1 is a block diagram illustrating a prior art field development method.

In the description that follows, like components are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

As discussed above, current offshore field develop processes are aimed at minimizing overall project cost so as to minimize risk if the project fails and maximize profitability if the project succeeds. As an alternative, embodiments of the present invention seek to reduce risk by minimizing project costs that must be committed prior to the first few producing wells coming on line. Several major benefits arise from this modification of procedures, including delaying the commitment of funding until after the necessary information has been acquired and using initial production proceeds to offset project expenditures as the development expands.

Figure 2:
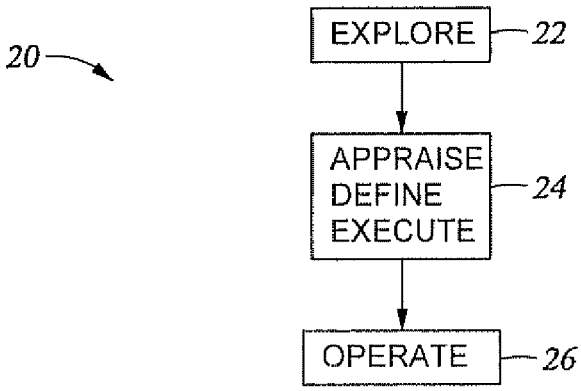
FIG. 2 is a block diagram illustrating a field development method in accordance with embodiments of the present invention.

Referring now to FIG. 2, a development process 20 may comprise exploring the offshore field 22, concurrently appraising the field, defining the development, and executing the project 24, and operating the field 26. Under process 20, exploration 22 would be undertaken with standardized, pre-designed components. These components would be able to shift from exploration to production and obtain information about the potential of the field to enable the appraisal, definition and initial execution of a development plan 24. The initially installed components could then shift to operating the field 26 or could be replaced by equipment specifically selected in response to information learned during the initial production process.

Figure 3:
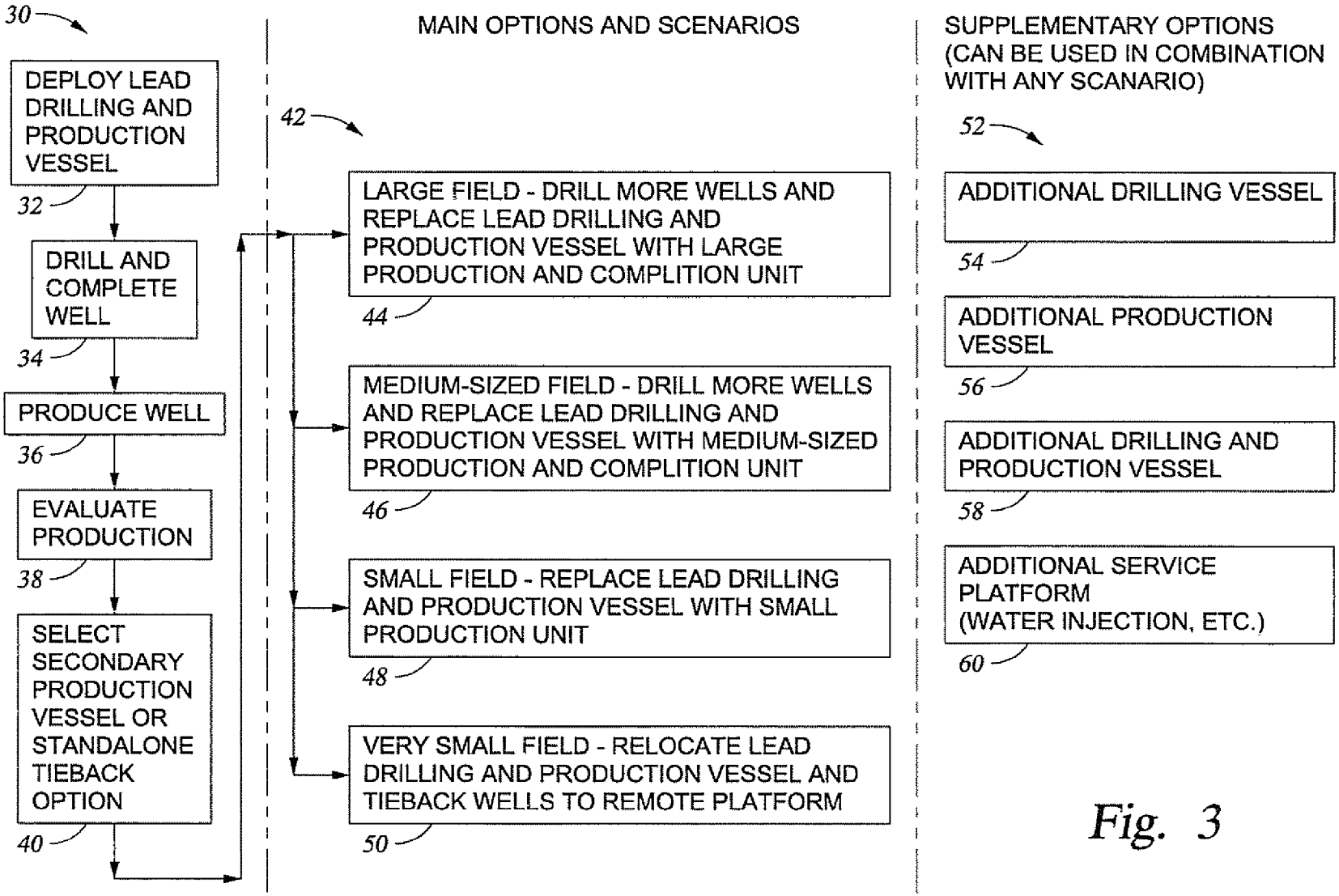
FIG. 3 is a block diagram illustrating a field development method in accordance with embodiments of the present invention.

For example, as shown in FIG. 3, a development method 30 may comprise deploying a lead drilling and production vessel to an offshore field 32 and drilling and completing at least one well in the offshore field 34. The lead drilling and production vessel would then initiate production from the at least one well 36. The production from the at least one well would then be evaluated 38 in order to formulate a plan for operating the field.

If the lead vessel does not have the capabilities to support the operation of the field a secondary production vessel is selected 40, based upon the evaluated production from the at least one well and the operation plan. The lead vessel would then be replaced by the secondary production vessel to support production of the at least one well and the ongoing operation of the field 42 in accordance with the operation plan.

If the field is to be operated as a large field 44, the lead drilling and production vessel could be used to drill additional wells and them be replaced with a large production and completion unit. If the field is to be operated as a medium-sized field 46, the lead drilling and production vessel could be used to drill additional wells and them be replaced with a medium-sized production and completion unit. If the field is to be operated as a small field 48, the lead drilling and production vessel could be replaced by a small production unit. If the field is to be operated as a very-small field 50, the wells drilled could be tied back to a remote platform.

During the operation of the field, the production is evaluated and the plan for operation can be modified if desired. If desired, a follow-on production vessel can be deployed to the offshore field 52 to replace or support the secondary production vessel in the development and/or production of the field. For example, an additional drilling vessel 54, an additional production vessel 56, an additional drilling and production vessel 58, or an additional service platform 60, such as a water injection unit, can be deployed to support or replace the secondary production vessel. Additionally or as an alternative, the secondary production vessel may be upgraded or modified to more efficiently manage the operation of the field.

One key to the efficient and cost-effective implementation of the development methods described herein is the use of standardized component designs that can be adjusted to a range of conditions and have modular components that allow for the separation of systems architecture such that the components that must be purpose-designed and built can be isolated. The systems would also preferably include interfaces that allow groups of components to be combined as generic pre-designed, reusable assemblies that allow for individual components to be removed and replaced as needed. The modularity and interchangeability would apply to small components, such as an individual valve manifold, to larger components, such as the floating system itself being able to be replaced by another floating system. The standardized and modular components and systems may include elements of the following: mooring lines; mooring systems designed for fast installation of anchors; riser components; hulls; topsides modular structures; subsea wellheads; subsea controls; subsea gas storage; and export interfaces.

One such modular system is a modular installation vessel that can be configured for use in the installation of several of the sub-components and systems. One such modular installation vessel is described in U.S. patent application Ser. No. 11/739,141, which is hereby incorporated by reference herein for all purposes. When planning a large project, the capabilities of the available installation vessels are very important because there are very few vessels that can do large deepwater projects. Any one large market will have only one or two large installation vessels available at a time. Therefore, all projects in that geographical area must be designed around the capabilities of that vessel that will typically drive the structural design of the topsides deck, the systems used for maneuvering the hull, and the components of both the mooring and riser systems.

Figure 4:
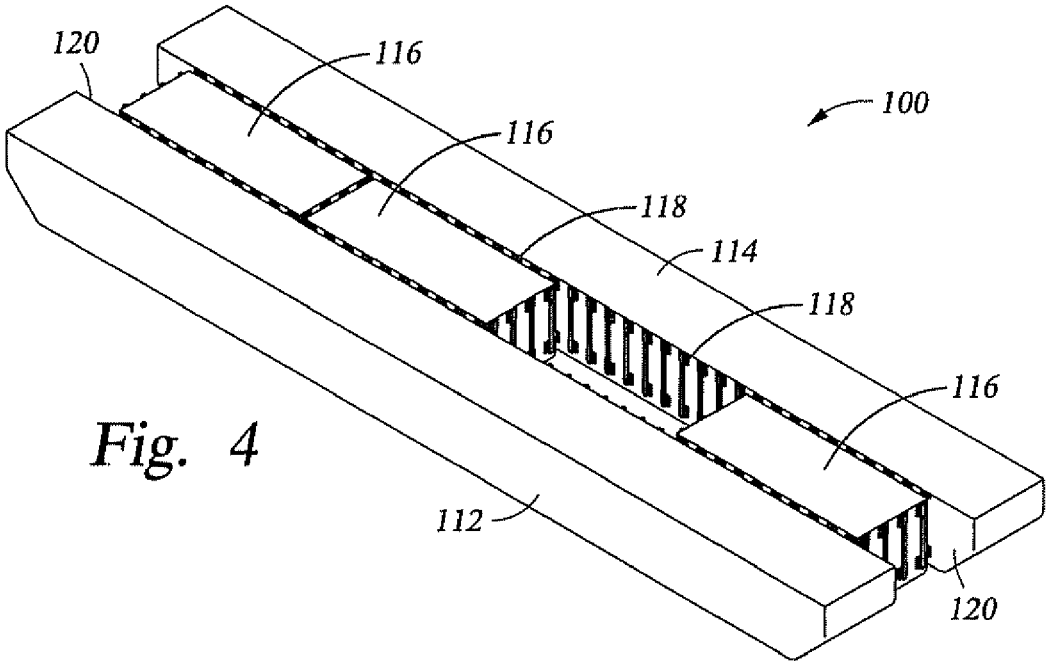
FIG. 4 is a modular installation vessel.

One example of a modular installation vessel is shown in FIG. 4. A configurable vessel 100 comprises a first pontoon barge 112, a second pontoon barge 114, and a plurality of interconnecting barges 116. The pontoon barges 112 and 114 each have a plurality of connecting members 118 disposed on their respective inboard sides 120. Each interconnecting barge 116 has connecting members 118 disposed on each side. The connecting members 118 allow the pontoon barges 112 and 114 to be assembled with interconnecting barges 116 in a variety of configurations so that vessel 100 can be used in support of multiple installation operations.

Figure 5:
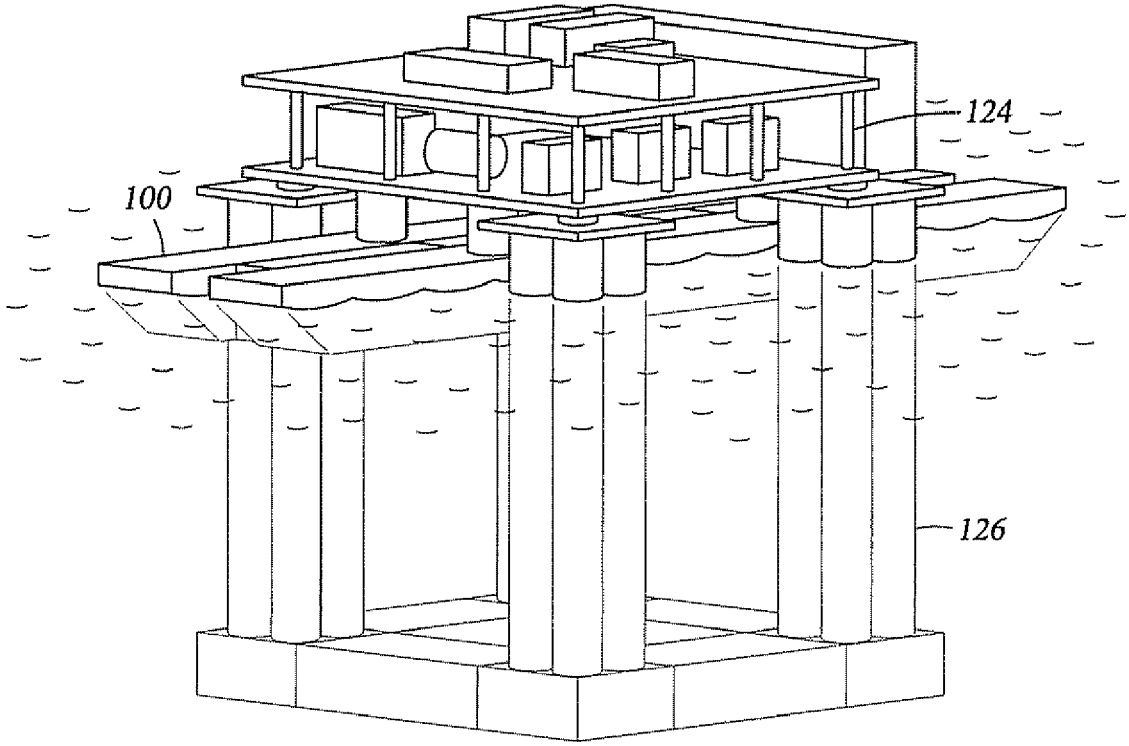
FIG. 5 illustrates the modular installation vessel of FIG. 4 being used in the installation of a topsides.

In one configuration, vessel 100 is especially well suited for the float-over installation of a topsides 124 onto a partially submerged semi-submersible hull 126, as is shown in FIG. 5. Topsides 124 is placed onto vessel 100 and transported to semi-submersible hull 126. Semi-submersible hull 126 is lowered in the water using the hull's ballast control systems and vessel 100 moved between the legs of the semi-submersible until topsides 124 is in the proper position. Once properly positioned, hull 126 is raised to lift topsides 124 off of vessel 100.

Figure 6:
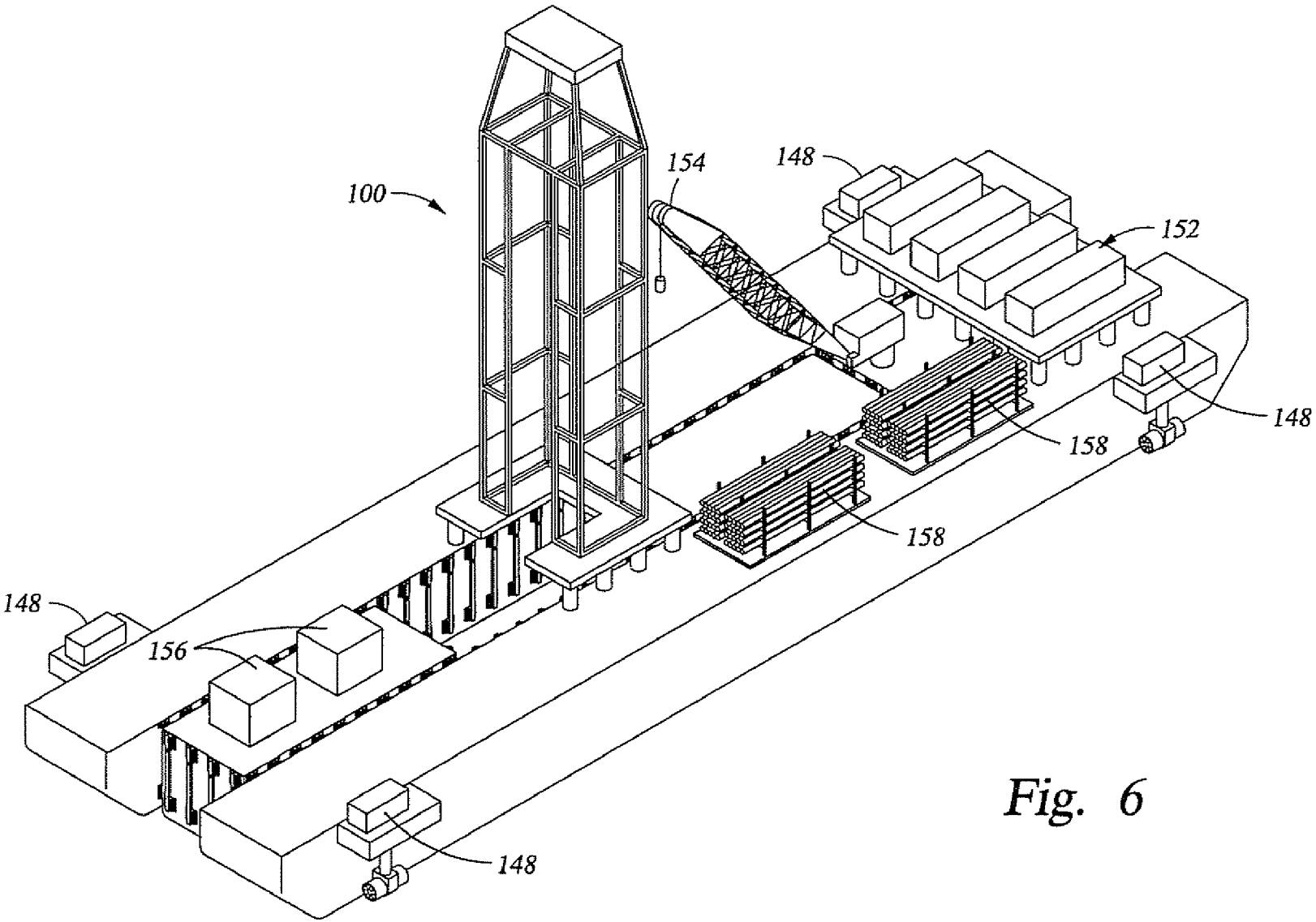
FIG. 6 illustrates the modular installation vessel of FIG. 4 being used to install subsea equipment.
Figure 7:
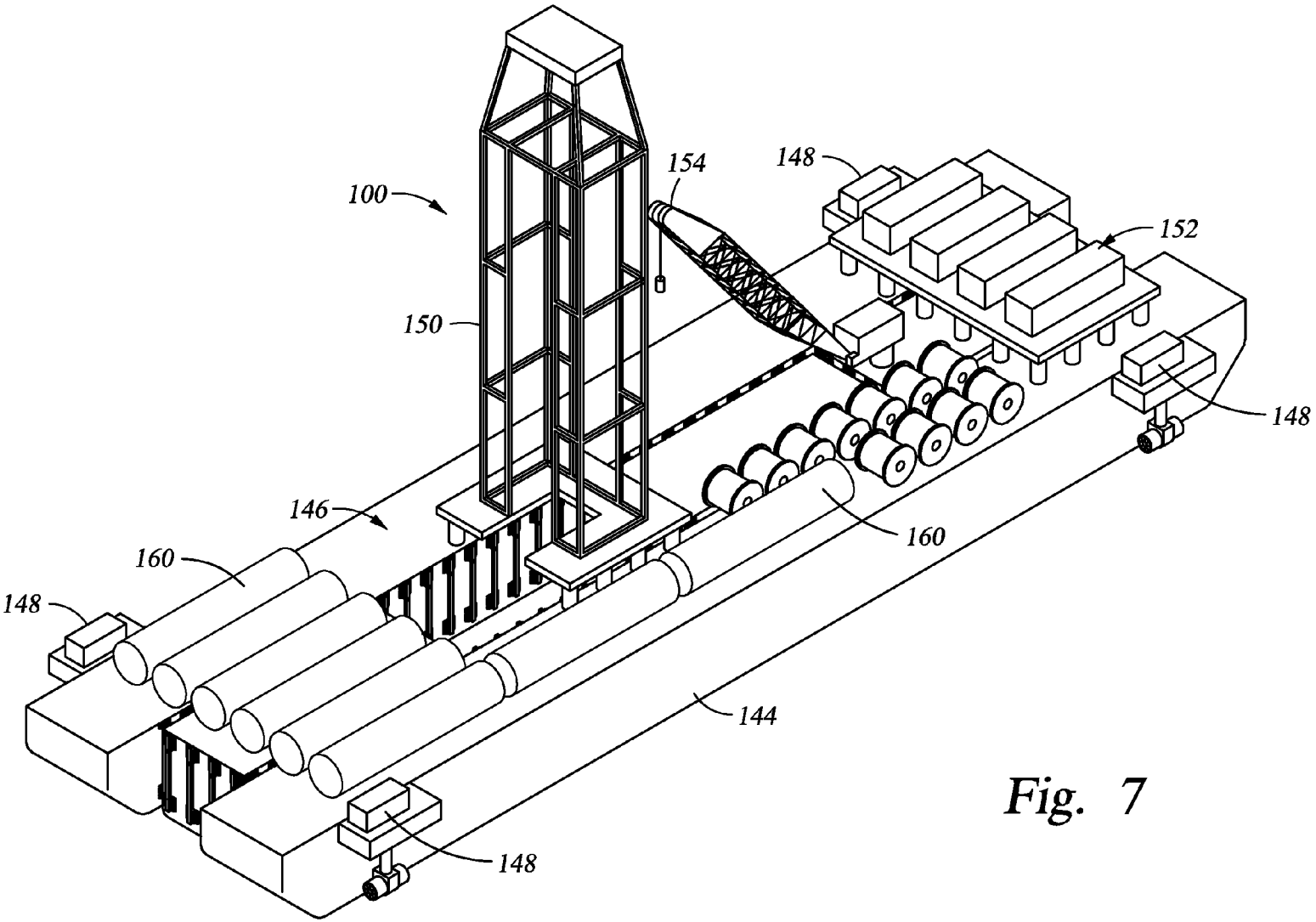
FIG. 7 illustrates the modular installation vessel of FIG. 4 being used to install suction anchors.

FIGS. 6 and 7 illustrate two possible uses of vessel 100, where the vessel has been equipped with modular thrusters 148, a lifting/lowering system 150, and crew quarters 152. Modular thrusters 148 are positioned on each corner of vessel 144 and provide the controllable, directional thrust needed to propel and position the vessel during installation operations. Lifting/lowering system 150 is disposed adjacent to moon pool 146 and may be a winch or derrick-based system that can be used to lower equipment to the seafloor. Crane 154 may also be positioned on vessel 144 to aid in handling and moving equipment. Crew quarters 152 provide operational and berthing areas for the personnel needed to operate vessel 144.

Referring now to FIG. 6, vessel 100 is shown being used in the installation of subsea wellhead modules 156. Vessel 100 provides a large amount of deck space for storing multiple modules 156 as well as large diameter pipe 158 and other materials needed for the installation of the modules subsea. FIG. 7 shows vessel 100 being used in the installation of subsea suction anchors 160 that are commonly used in offshore mooring applications. As a typical mooring application will use many anchors, the large deck space of vessel 100 allows the vessel to install several anchors without being re-supplied, therefore reducing the time needed to install all of the anchors for a given system.

Figure 8:
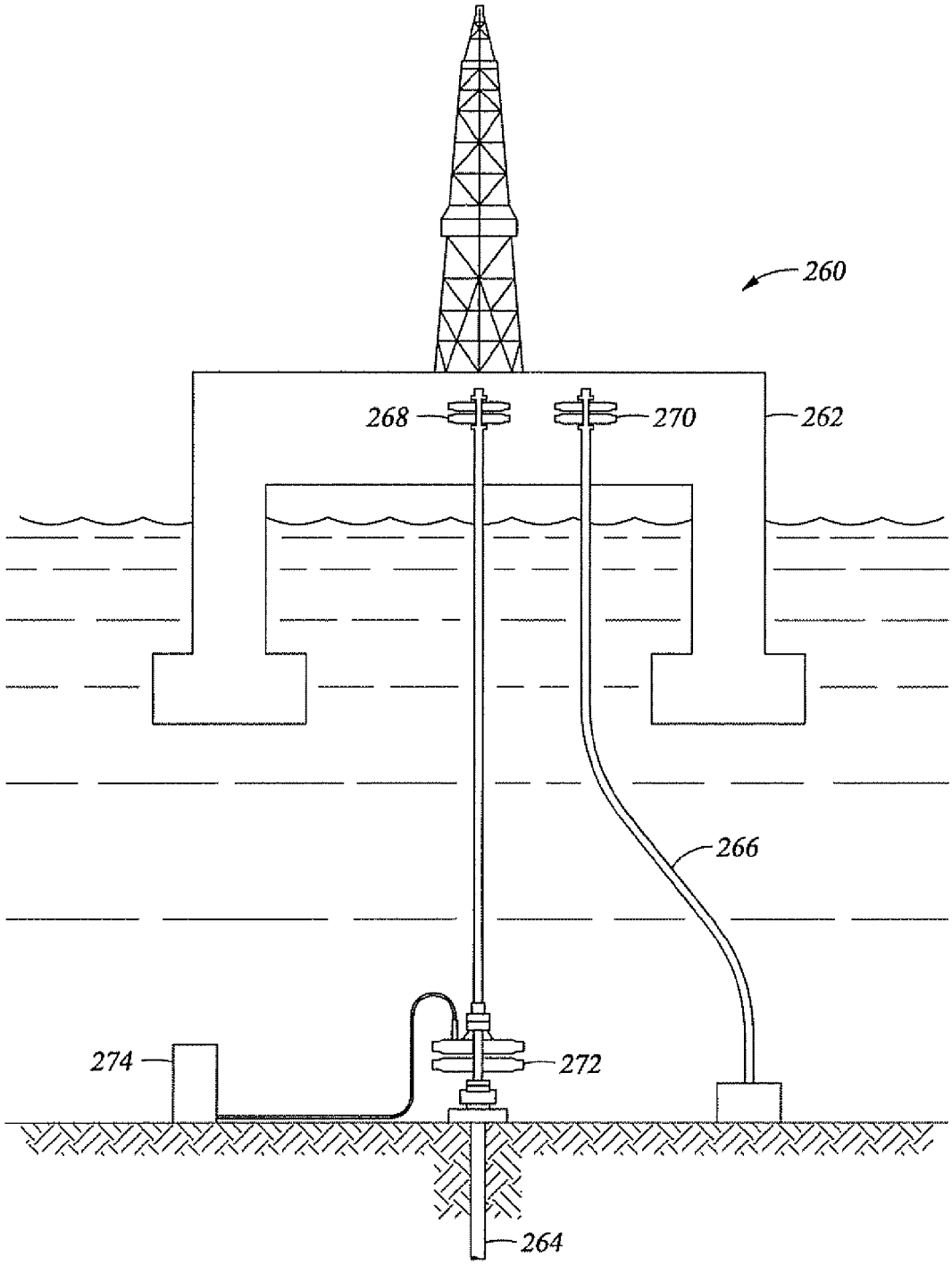
FIG. 8 is a partial schematic illustration of one embodiment of a lead drilling and production vessel.

Another vessel used with the development methods described herein is a lead drilling and production vessel that has the capability of drilling, completing, and producing at least one well. In one embodiment as is shown in FIG. 8, the lead drilling and production vessel 260 has a large hull, such as a deep-draft semi-submersible hull 262, with a capacity of about 20,000 short tons. The lead drilling and production vessel may be designed with a deep draft that is sufficient to provide favorable heave characteristics in extreme storms, which are required to use vertically tensioned riser systems for both production and drilling. The drilling systems and associated tensioning systems may be designed to stay connected during extreme hurricanes and sea states, thereby greatly simplifying the drilling systems by allowing the use of surface blowout preventers (BOP's).

The purpose of the lead drilling and production vessel 260 is to drill a few wells and start production immediately for the purposes of accelerating cash flow to offset expenditures as well as for the purposes of starting the reservoir evaluation process using data from production and downhole sensors. This lead vessel can be leased out for a given period of time, where the length of the lease is intended to cover at least the period required to drill the initial wells and produce for a period of time required to ensure the reservoir models can be properly updated and then to select the vessel that will be used to produce the field. The lead drilling and production vessel 260 is therefore designed to be able to drill a well 264 while receiving production from a vertical riser system 266. The lead drilling and production vessel 260 may use surface pressure control equipment, such as a surface BOP 268 and a surface (dry) tree 270, to provide pressure control at the rig, therefore reducing the amount and complexity of subsea equipment and simplifying maintenance. The surface pressure control equipment may be supplemented by additional seafloor shutoff valve 272, which could be driven using an independent control system 274.

Figure 9:
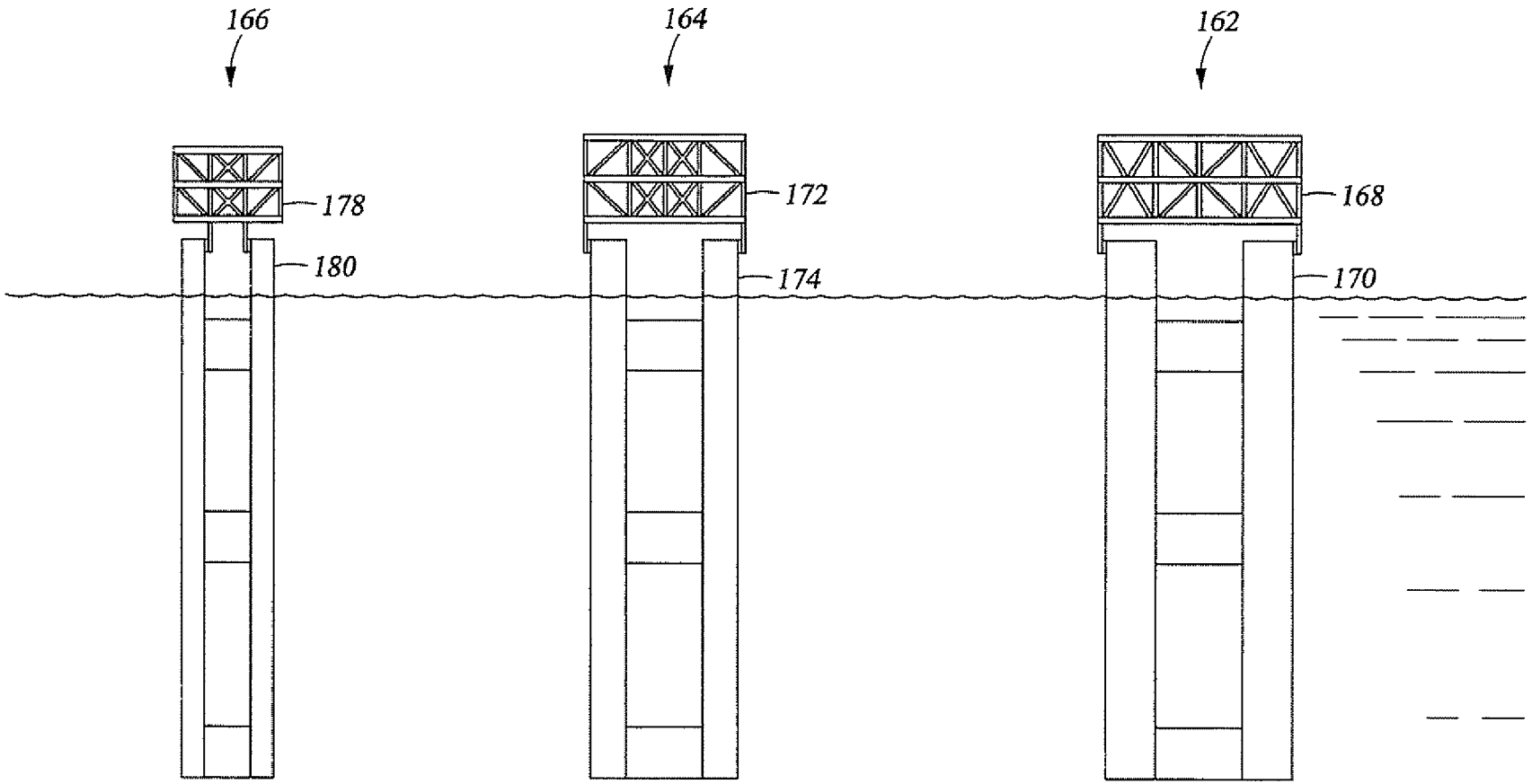
FIG. 9 is a schematic illustration of three floating platforms of various sizes.

In many instances, the lead drilling and production vessel will move from a project once the field is initially evaluated and be replaced by a secondary production vessel. The secondary production vessel may be any one of a series of platforms, such as those shown in FIG. 9, including large completion and production unit 162, medium-sized completion and production unit 164, and small production unit 166. In some embodiments, large completion and production unit 162 comprises a modular topsides unit 168 capable of supporting the production of 100 KBOPD (thousand barrels of oil per day) disposed on large hull 170 with a 20,000 short ton (ST) capacity. Medium-sized completion and production unit 164 may comprise a modular topsides unit 172 capable of supporting the production of 40 KBOPD disposed on a medium hull 174 with a 10,000 ST capacity. Small production unit 166 may comprise a modular topsides unit 178 capable of supporting the production of 20 KBOPD disposed on a small hull 180 with a 3,000 ST capacity.

Figure 10:
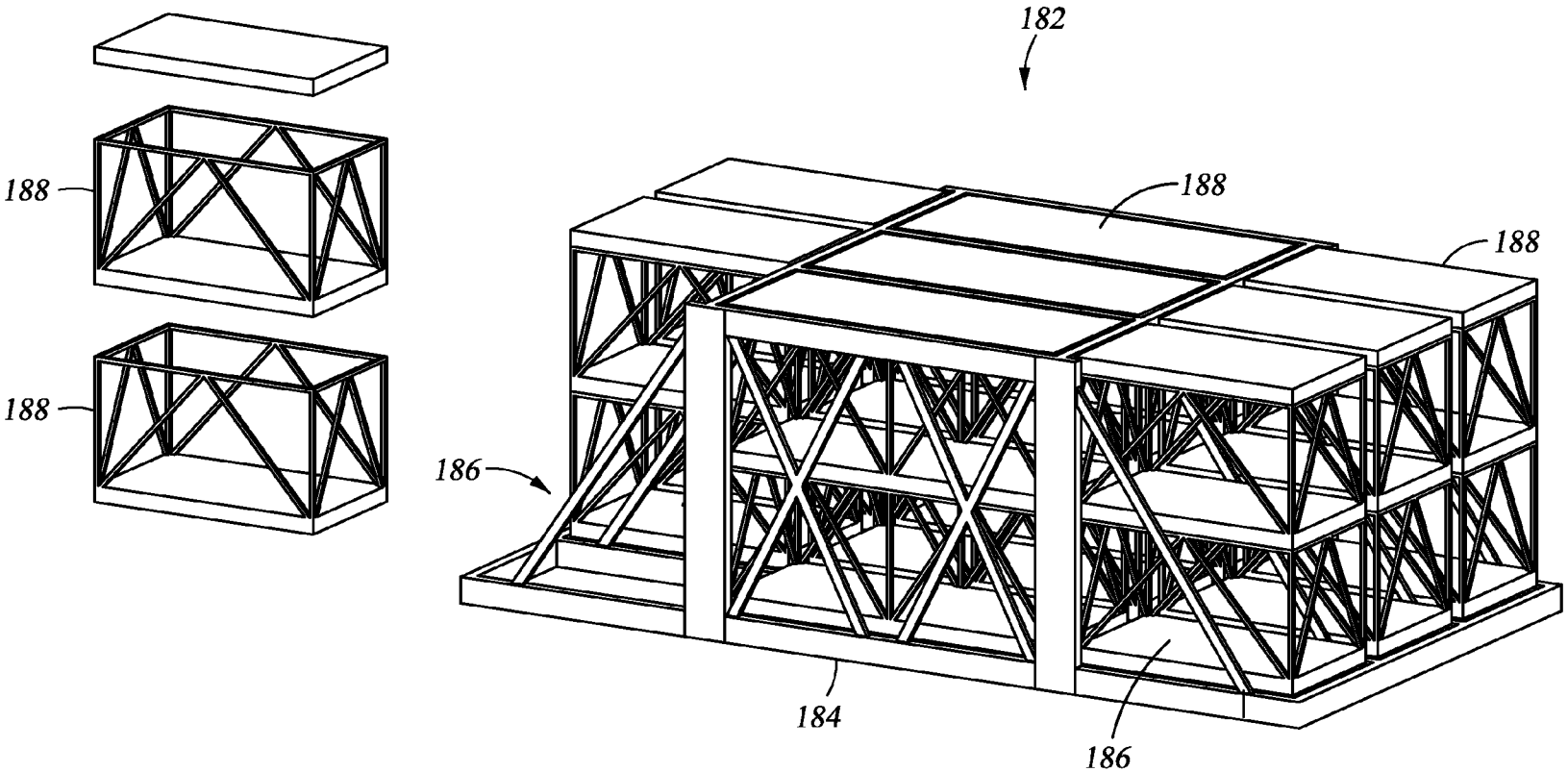
FIG. 10 illustrates one embodiment of a modular topsides unit.

The modular topsides units can be used to ensure that the changing process needs of a specific field can be accommodated. Modifications should be expected both for a single field, as the reservoir understanding changes, as well as when the vessel relocates from one field to another. Referring now to FIG. 10, modular topsides unit 182 comprises a central base 184 that provides strength and provides a backbone that supports open structural hangars 186 on each side of the base for supporting modules 188. Modules 188 may be configured in one of several categories, including: quarters, utilities, production, chemical injection, well control, and export. A given application may have several modules in each category in order to fit the proper equipment into the allotted spaces. Each module is organized into a self-supporting system that can be built and lifted separately and then joined into a central ring manifold for all utilities.

Figure 11:
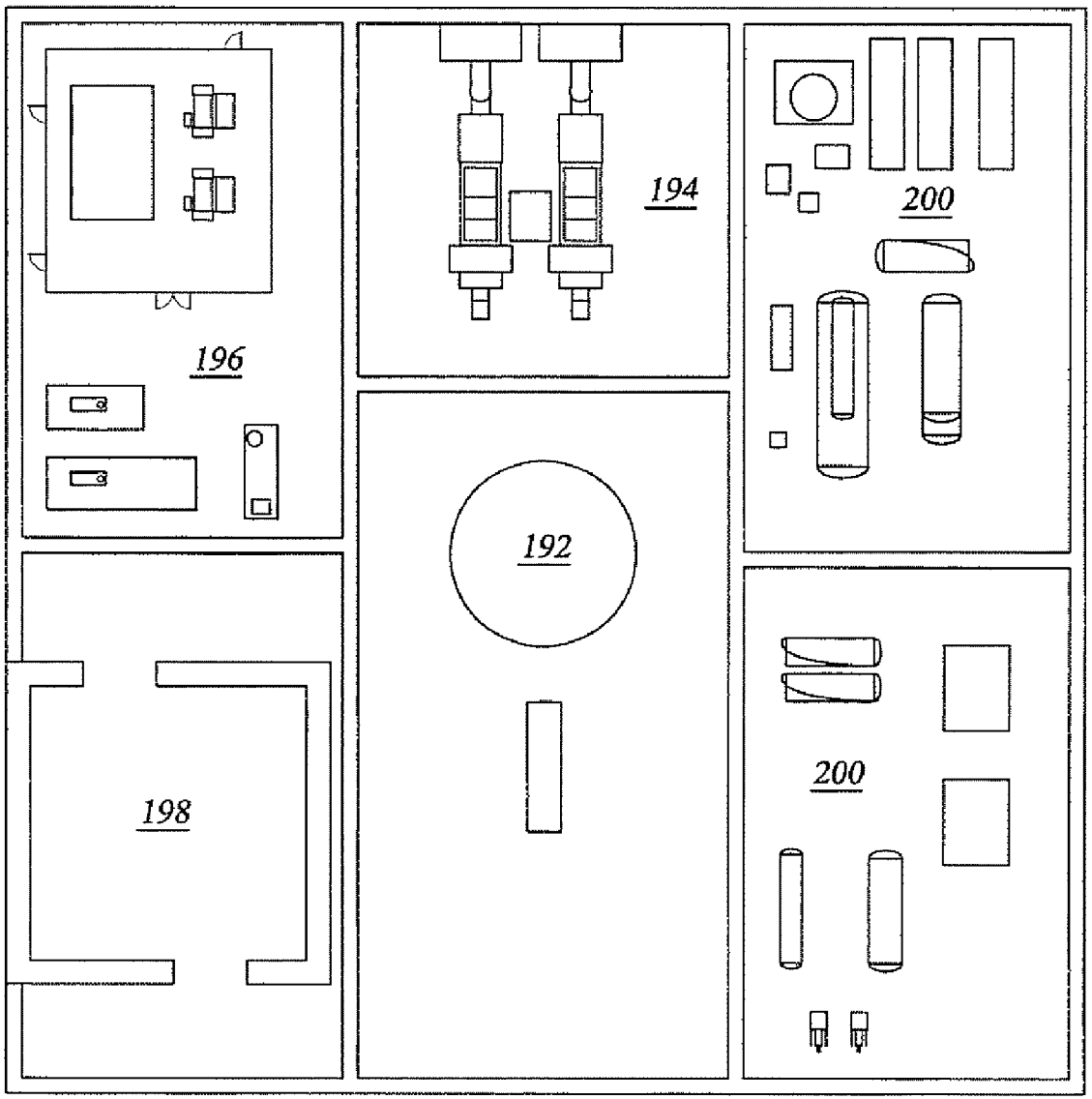
FIG. 11 is a layout view of a modular topsides unit.

Referring now to FIG. 11, a plan view of one embodiment of a topsides unit 190 is shown. Topsides 190 includes modules for drilling 192, power generation 194, utilities 196, quarters 198, and production 200. A generalized architecture is pre-designed to ensure logical separation of the systems and the simplest possible interfaces. Various changeout operations are anticipated in the design, including replacement of equipment within a single module, replacement of an entire module, and replacement of the entire topsides unit.

The replacement of a single piece of equipment is provided for by locating the equipment that is most likely to need replacement or modification on the outside of the facility or in areas that are most accessible by cranes and constructing the individual module packages with an open space frame arrangement to enable easy access to equipment. The structural connections between the modules and the base structure are preferably configured to allow a single module to be entirely replaced while offshore or in a shipyard. An individual module can be lifted using a derrick barge or by a crane that is mounted on the base structure and moved to a barge or other location. In some cases, the desired modifications may be so major that it may be more convenient to remove the entire unit and move it to shore before reinstalling it on the floating system. This can be done by ballasting the vessel down and floating the topsides off onto a modular installation vessel.

Figure 12:
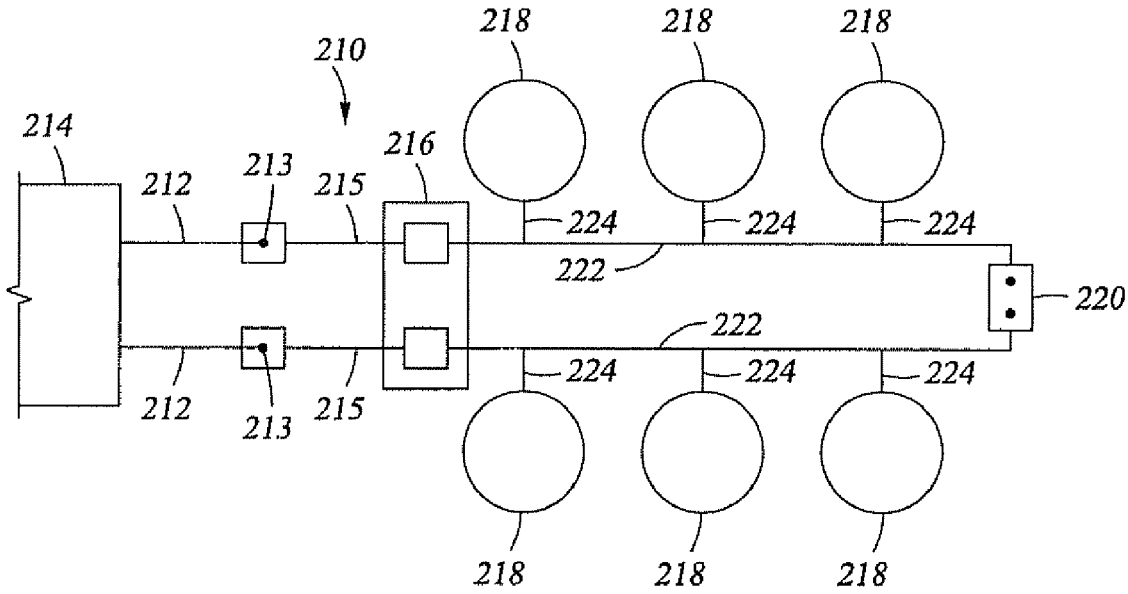
FIG. 12 is a schematic illustration of a modular export system in a first configuration.
Figure 13:
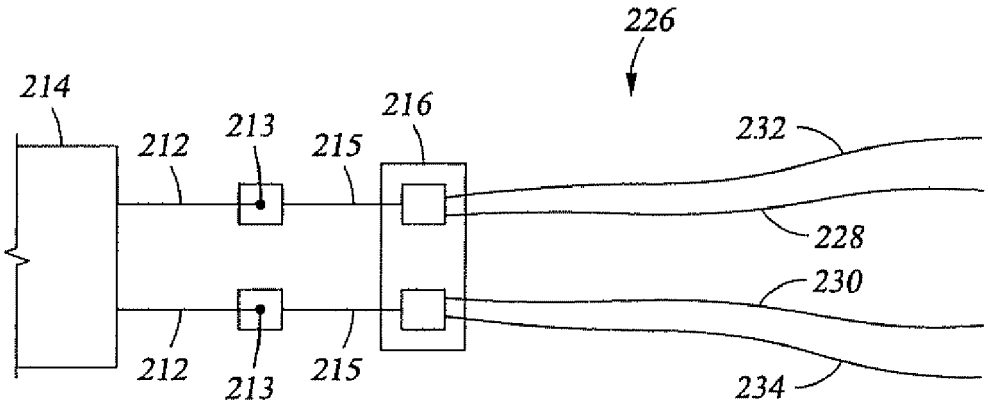
FIG. 13 is a schematic illustration of a modular export system in a second configuration.

Another important component of an offshore field development is the system used to export the hydrocarbons produced from the offshore field to a land-based refinery or other production facility. Referring now to FIGS. 12 and 13, modular export facility 210 comprises a large diameter riser 212 that is connected from the surface production facility 214 to a subsea export manifold 216 via subsea terminals 213 and jumpers 215, which provide fluid communication and control from the surface production facility. The subsea export manifold 216 will remain on location for the entire duration of the field life and can be connected to a variety of different export facilities depending on the perceived needs at each stage in the development.

In certain situations, such as the early stages of production, subsea oil and gas storage tanks 218 are provided to store produced oil and gas. A surface buoy 220 is provided to export the stored oil and gas to offloading tankers for shipment. The subsea storage tanks 218 are modular units that are connected to a main export pipeline 222 with valve branches 224. Thus, if more storage tanks can be added as necessary, providing a fully scalable system.

Referring now to FIG. 13, a pipeline system 226 can be used as a replacement or alternative to the tank system of FIG. 12. Pipeline system 226 may comprise an initial gas pipeline 228 and an initial oil pipeline 230 that can be small diameter pipelines for supporting production from a small number of wells. As the field expands and more wells are being produced, additional, larger diameter pipelines 232, 234 can be added to increase export capacity.

Figure 14:
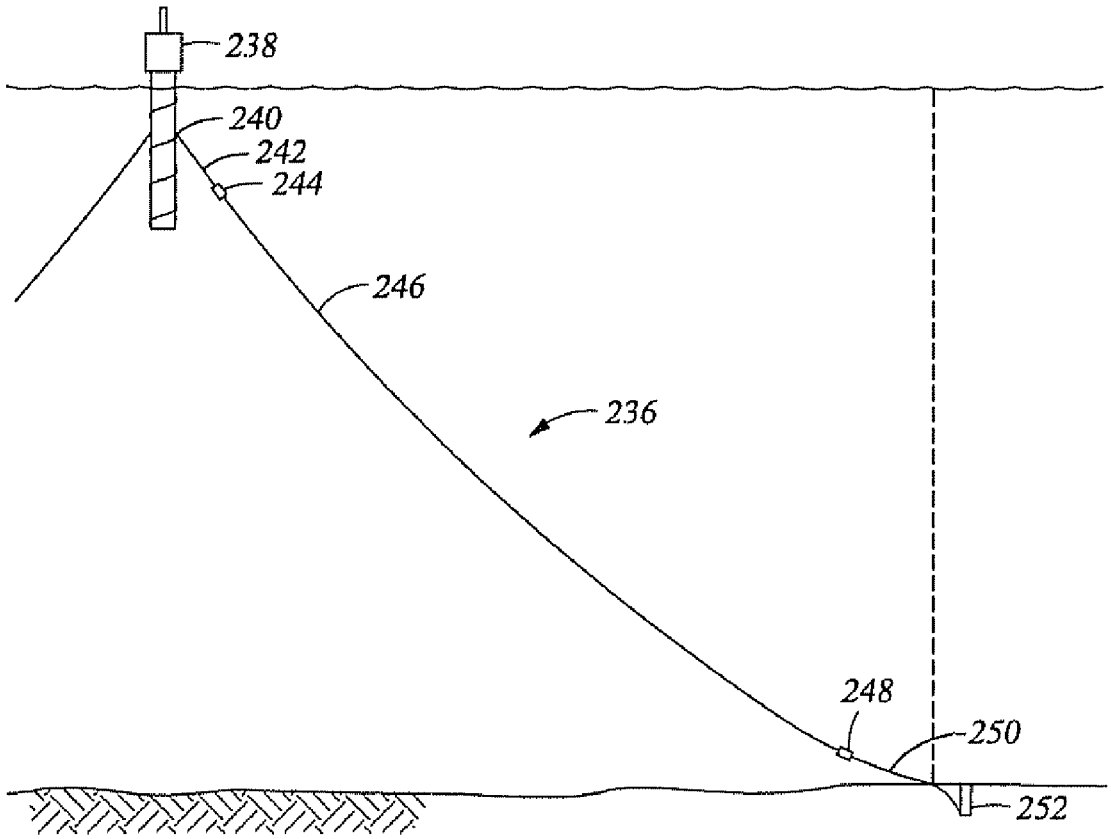
FIG. 14 is a partial view of a mooring system.
Figure 15:
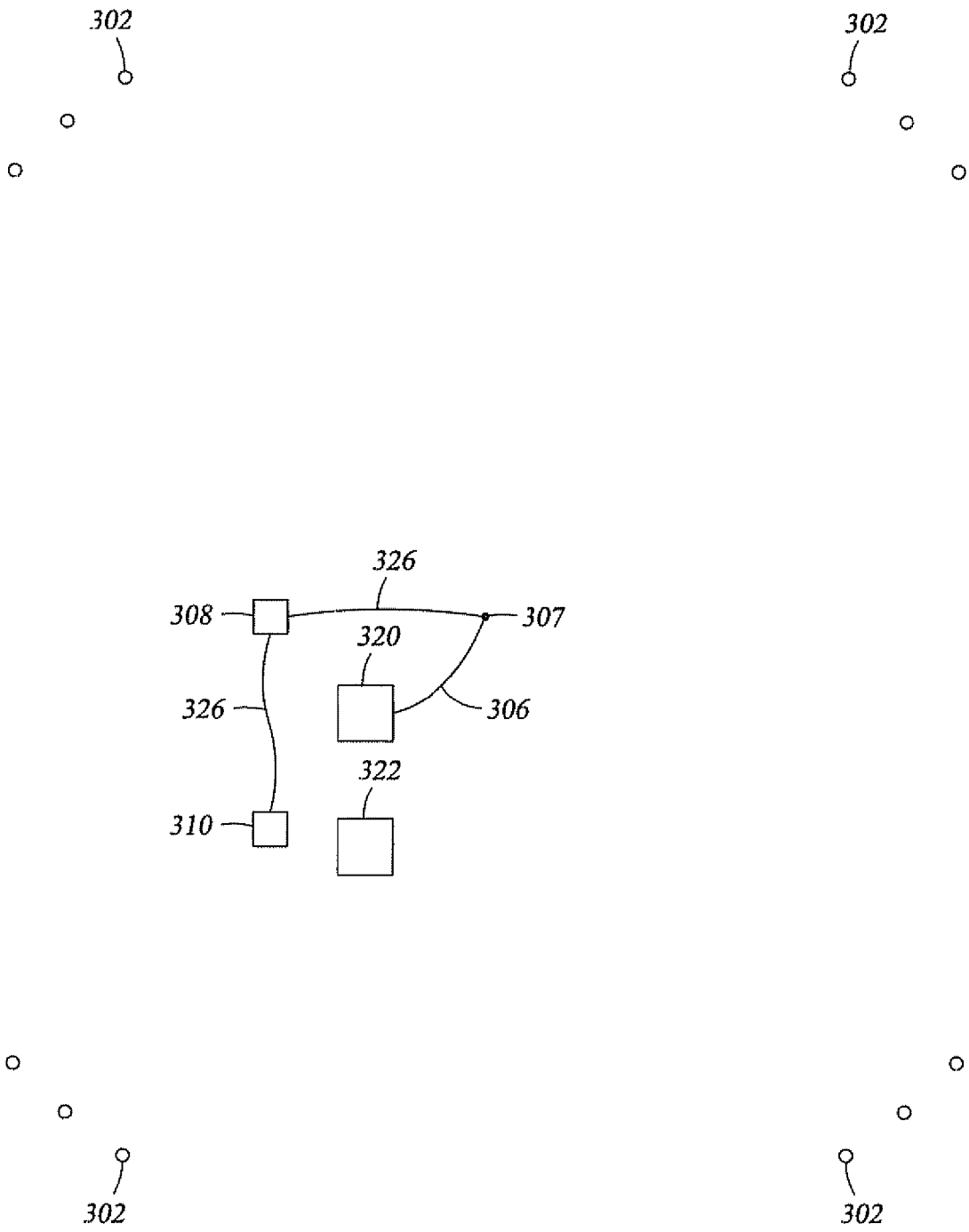
FIGS. 15-21 are schematic illustrations of a field in various phases of development.

Referring now to FIG. 14, a flexible mooring system 236 for platform 238 comprises fairlead 240, top chain 242, top chain connector 244, polyester rope 246, bottom chain connector 248, bottom chain 250, and anchor 252. Mooring system 236 is configured for easy redeployment by utilizing bottom chain connector 248, which allows disconnection of nearly all of the mooring line. The use of polyester rope 246, or other lightweight materials, is preferred because the line loads on platform 238 and the capacity of system 236 do not change significantly with water depth, thereby enhancing the flexibility of the system.

The various sizes of floating vessels and platforms described above are designed to use the same line size and mooring systems, although larger vessels may require more mooring lines than smaller vessels. Using this system, if a larger vessel were to be replaced by a smaller vessel, most of the mooring system could remain in place. Because expected mooring loads are site dependent, a particular vessel may need more mooring lines at one site than at another. For this reason, the vessels can be designed to accommodate the number of lines that are needed in the worst anticipated design conditions, although fewer lines may be deployed on a given application.

The previously described systems, as well as other systems known in the art, may be used in the development of a field as described in reference to FIG. 3. Referring now to FIGS. 15-21, the development of an exemplary field is illustrated. Prior to any drilling or field development activities, an installation vessel, such as the vessel described in reference to FIGS. 4-7, can install much of the seafloor equipment in order to allow the drilling and production vessel to focus on drilling the well and other critical path activities. The installation vessel can pre-install the anchors 302 and other components of the mooring system. The installation vessel can also set the subsea wells 320, 322 in location, set the anchor location for the vertical riser 307, and lay jumper lines 306 close to the eventual locations prior to the arrival of the drilling and production vessel. Components of the subsea control system, including the (subsea umbilical termination assembly) SUTA 308, the first distribution box 310, and control umbilicals 326, can also be installed on location.

Figure 16:
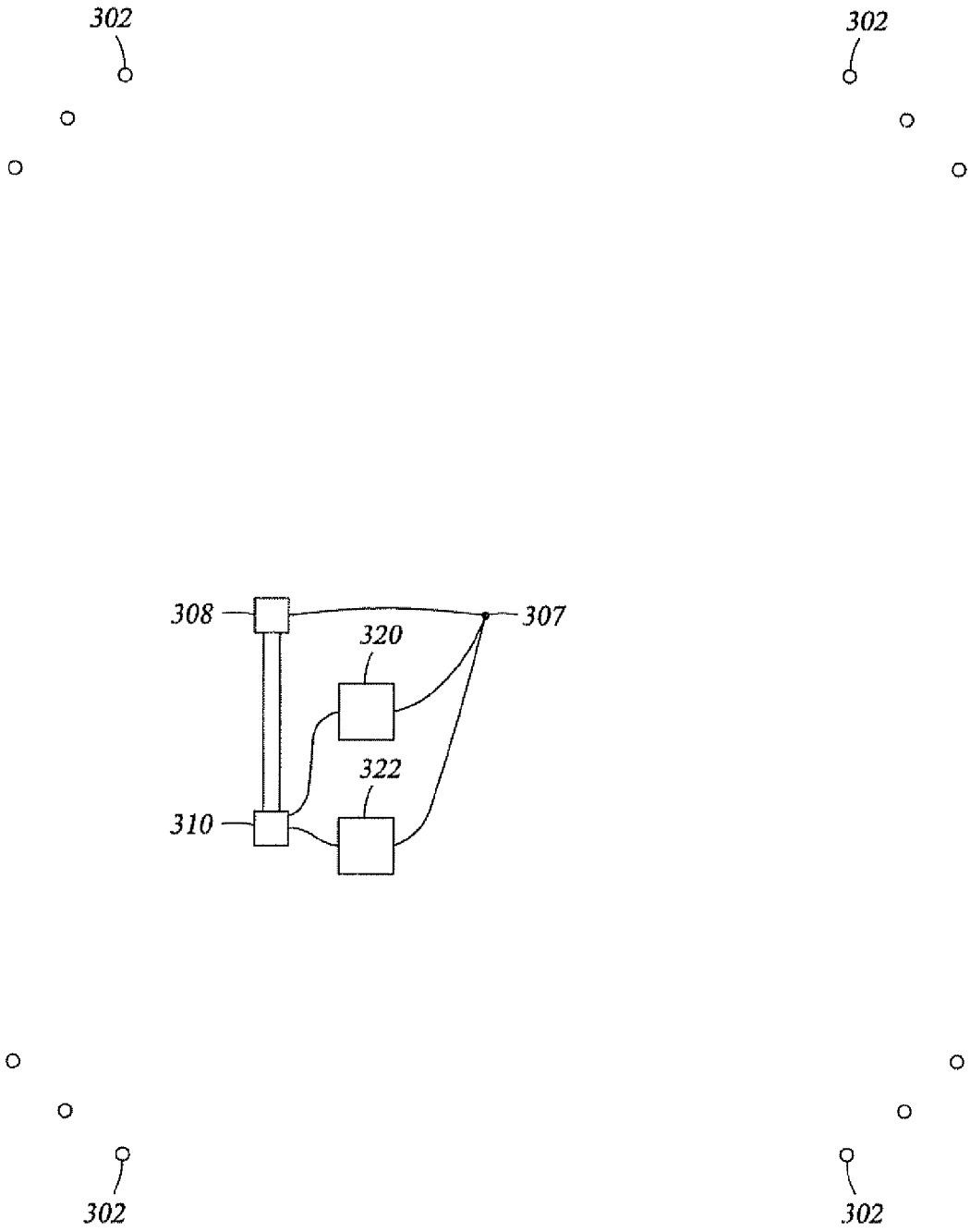

Once the lead drilling and production vessel is in place, a drilling riser is run and the first well 320 is drilled from the lead drilling and production vessel using the drilling riser. Once well 320 has been drilled, but not completed, the top hole of the second well 322 is drilled to the point that the wellhead can be set and the drilling riser is then parked on the wellhead of the second well. A completion riser is then run and connected to the first well 320 so that the first well can be completed. The drilling and completion risers can be run independently or the completion riser could be run inside of the drilling riser. Once the first well has been completed, it is brought into a production mode by running a production vertical tubing string from the vessel to the first well 320. On the surface, the production tubing is terminated in a surface tree, which allows for primary shutoff. At this point, production can commence from the first well 320. Once the first well 320 has been brought on production, the lead drilling and production vessel drills, completes, and brings into production the second well 322. FIG. 16 shows the field layout during the drilling operations for the first two wells.

Figure 17:
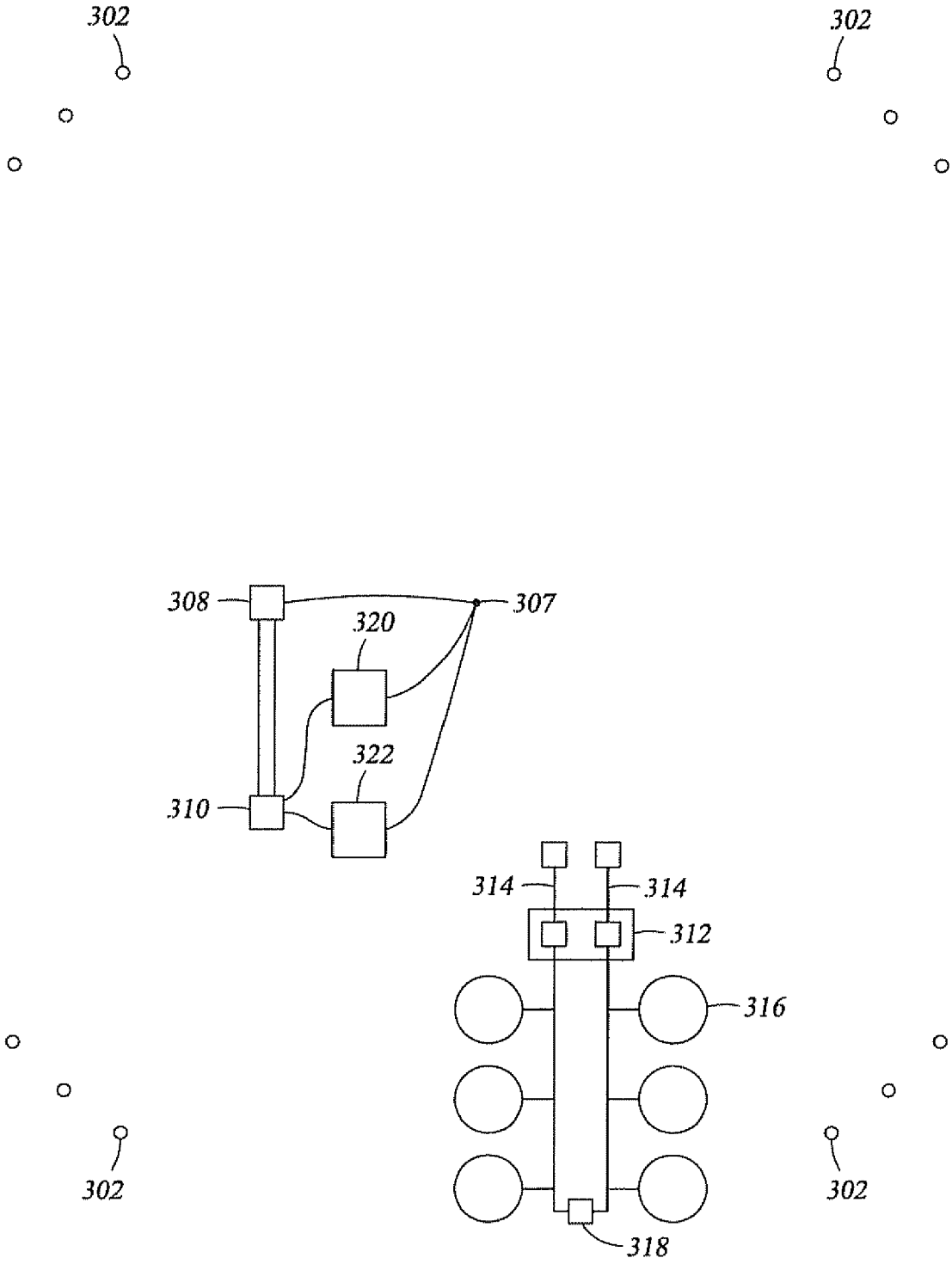

As illustrated in FIG. 17, the installation vessel can also install components of the modular export system, which may comprise modular export system skid 312, jumpers 314, storage vessels 316, and offloading risers and buoy 318. Based on various core and downhole information obtained during the initial drilling program, as well as the real-time history data collected during production, the reservoir understanding can be greatly enhanced. After a few months to a year of production data, models can be sufficiently defined to be able to provide adequate design information for the surface facility that will be used at that location. It is possible that sufficiently clear information is received during the drilling operations for the second well that a good plan can be devised immediately and the drilling operations can continue uninterrupted. If desired however, the lead drilling and production vessel can return to a central position over the well pattern for a period of time during which the production stream can be continually evaluated prior to either drilling more wells or making the decision to replace the initial vessel.

At this point, updated well and field development plans can be developed based on the reservoir conditions as measured on location rather than as postulated based on sparse and questionable data. The updated reservoir information can then be used as input into the well planning and subsequent facility design data that can be used to design the facility that will ultimately take the drilling and production unit's place on location. Once the reservoir conditions are better understood, the field development planner may wish to pursue the field development using one of a variety of methods.

Figure 18:
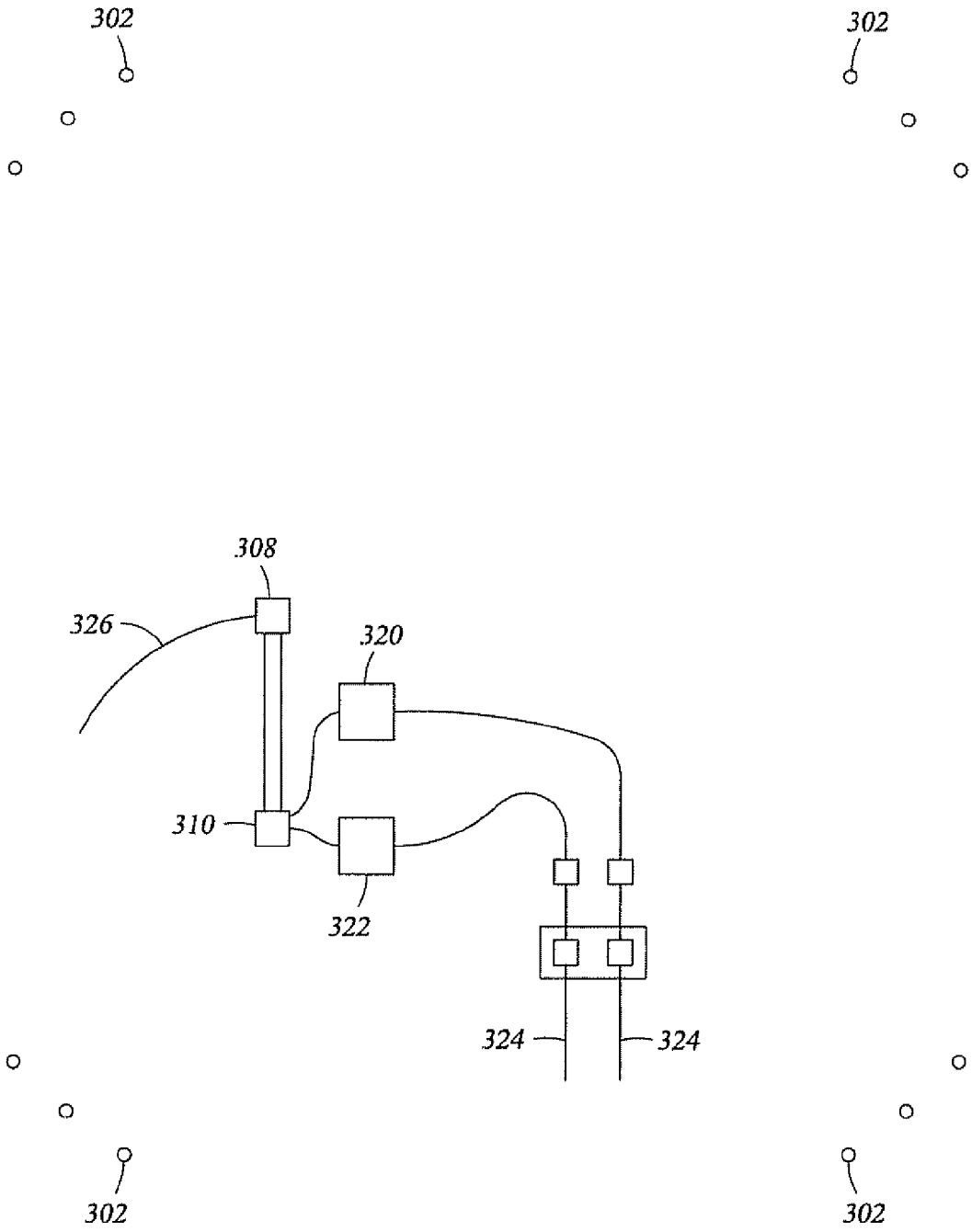

In one scenario, the field is very small and intervention does not seem to be justified but production properties allow for a long distance tieback. In this case, the field will be turned into a two well tieback, as shown in FIG. 18. In order to do this, the wells are coupled directly to the modular export system skid 312. The storage facilities 316 are removed and relocated to another location. Long distance flowlines 324 and a control umbilical 326 are connected to the modular export system skid 312 and the SUTA 308, respectively. All mooring lines can be removed and relocated to another field along with the lead drilling and production unit.

Figure 19:
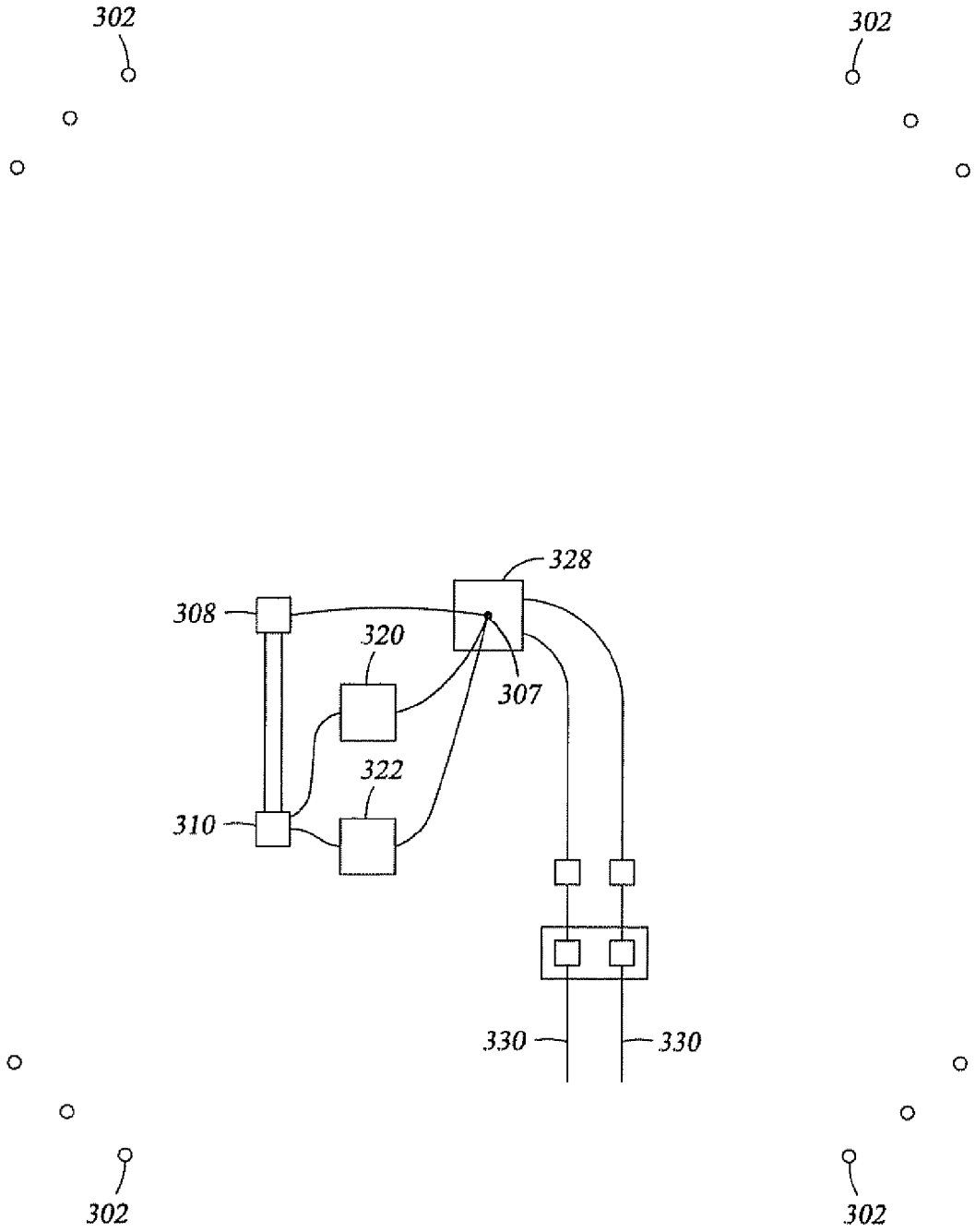

In another scenario, as illustrated in FIG. 19, the field is small and either intervention is desirable or the production properties indicate that flow assurance problems can be anticipated. In this case, a small production unit 328 will be used as a surface production facility that remains on site to provide access to the wells. The storage facilities 316 are relocated and a small diameter pipeline 330 is connected to the modular export system skid 312. The small production unit 328 will be placed over the wells 320,322 and will use the same riser system 307 that was used for the lead drilling and production vessel. The small production unit 328 may preferably have space allocated for wireline and/or coiled tubing units in order to perform interventions as required. Depending on the needs of the field, this vessel can be either sold to the company or leased for a limited period of time should that be desirable.

Figure 20:
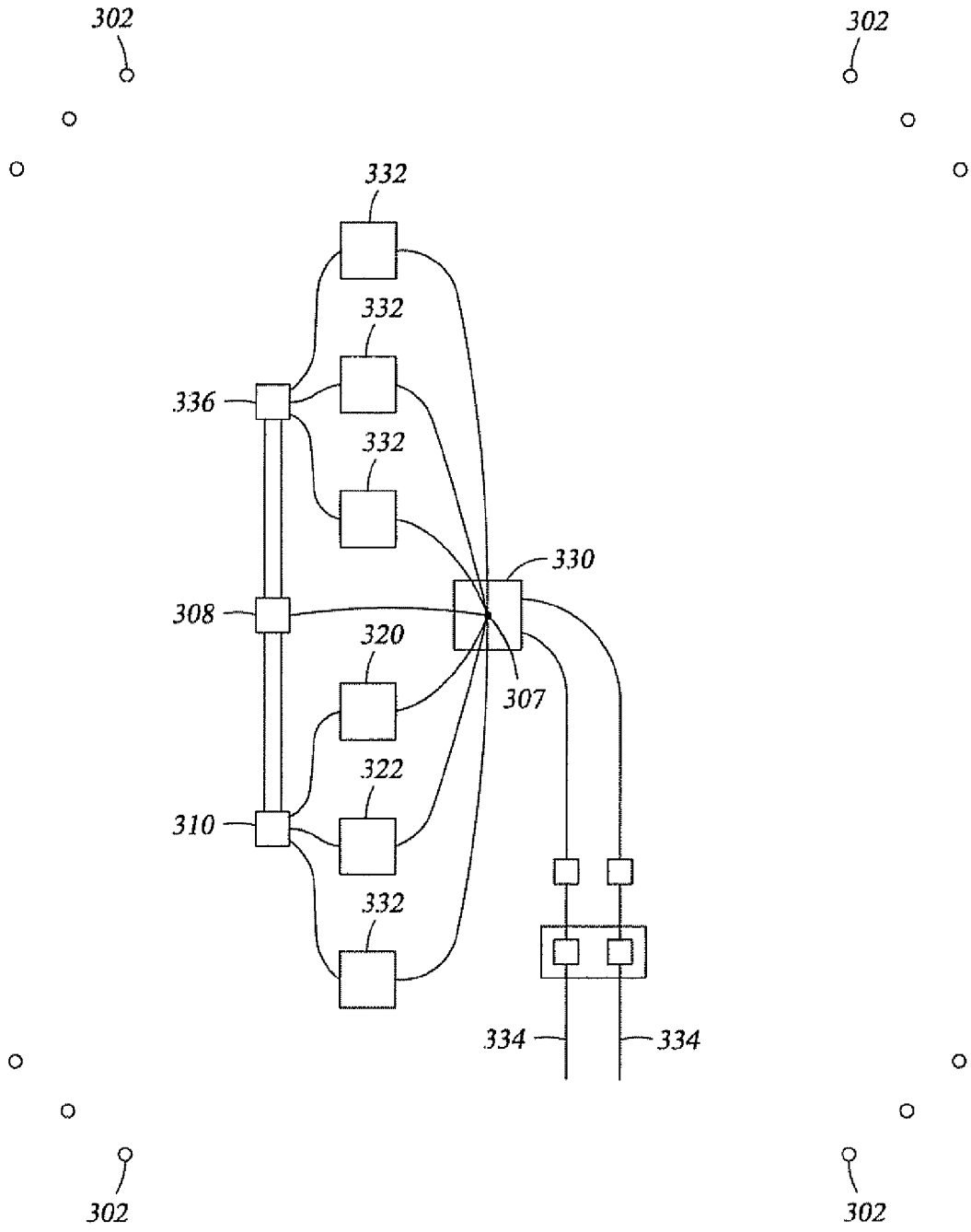

If the field proves to be somewhat larger, it may be desirable to drill a limited number of additional wells 332, as are shown in FIG. 20. In this scenario, the lead drilling and production vessel can be replaced with an intermediate sized production unit 330 for final depletion of the field. The production unit can also carry a completion and workover rig, although for high pressure applications, the required drilling weights may be too great for the hull capacity, which would require that lighter forms of intervention be used, such as coiled tubing or wireline units. In order to accomplish the transition from the lead drilling and production vessel to the intermediate sized production unit, a number of preparation steps can be taken to scale up the seafloor configuration while the drilling activities are on-going.

The storage facilities are removed and a small to medium diameter pipeline 334 is connected to the modular export system. An additional distribution box 336 and the additional jumpers are installed on the seafloor prior to the commencement of drilling activities. The drilling and production vessel is used to drill the additional wells. Installation of these additional components can be accomplished either using the vessel's surface lowering equipment or alternatively, the installation vessel can be brought back to location to perform these operations. Fewer mooring lines may be required for this application because of the smaller size of the production vessel as compared to the lead drilling and production vessel and therefore any unnecessary lines can be removed by the installation vessel.

Figure 21:
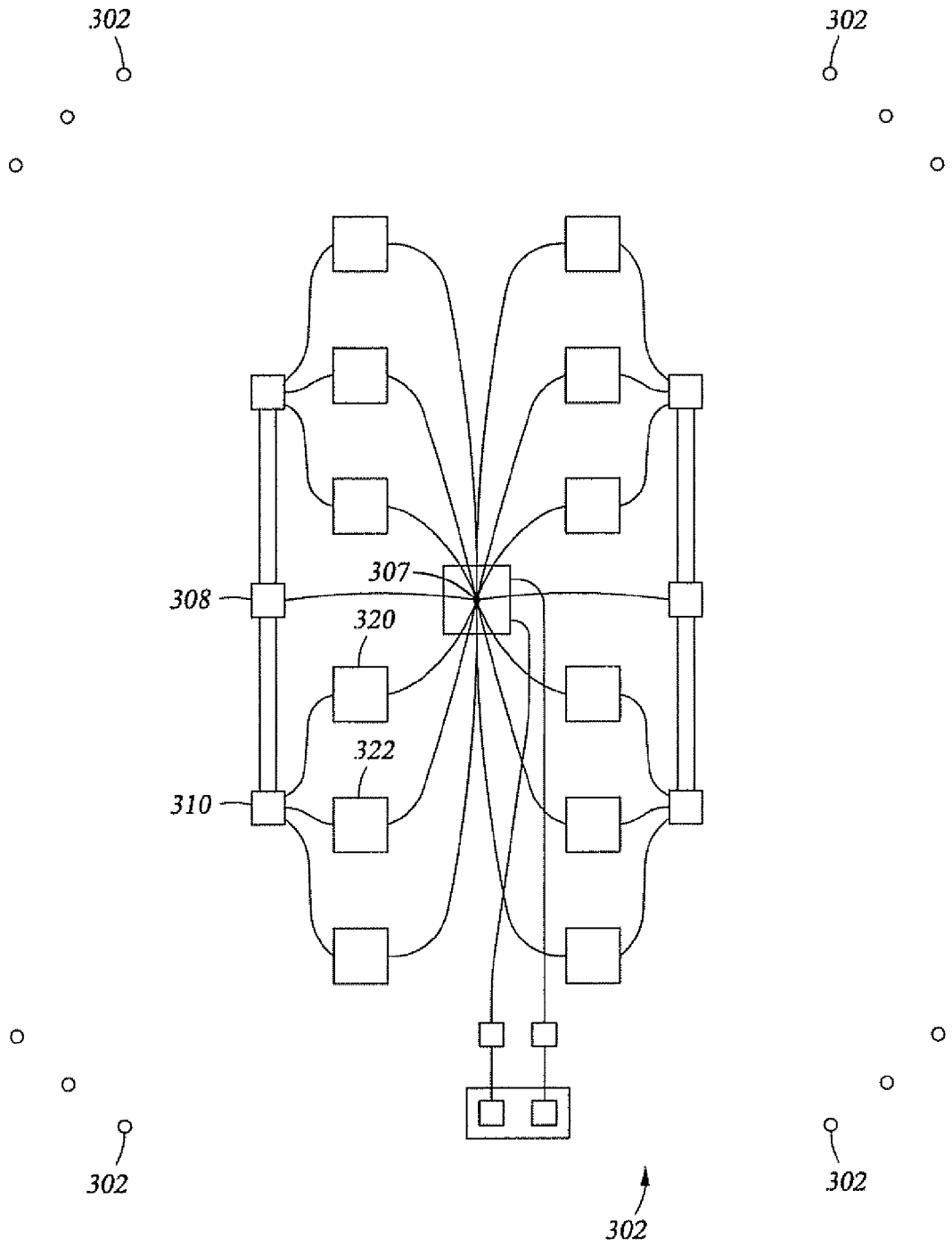

In another scenario, as illustrated in FIG. 21, the field is large and requires a large production unit. In this case, it is likely that workover and completion activities are desirable. Thus, the topsides will be designed for a more limited set of drilling equipment, preferably with just the workover and completion capabilities plus large production facilities. In this scenario, the additional wells can be drilled by the lead drilling and production vessel prior to the arrival of the large production unit. As wells are drilled and completed, they can be brought on production up to the limit of the lead drilling and production vessel. Once the large production unit arrives on site, it can be connected to the existing mooring system and to the producing wells. Additional export lines can be installed in order to provide additional export capabilities. The second vessel can be either leased or sold to the client as preferred.

In fields that may utilize a large production unit, it may be desirable to commence the upgraded production prior to the completion of drilling. In this case, the production unit can be built without any drilling rig at all and can be positioned near the lead drilling and production unit, which will be kept on station. The lead drilling and production vessel will be responsible for only the drilling program and the large production unit will be responsible for all other activities. In this case, the control systems distribution boxes will remain on the seafloor, but the SUTA's and control umbilicals will be run from the production unit rather than the drilling unit. The MES will remain in its original location and can have additional large diameter output pipelines added and its input jumpers relocated from the lead drilling and production vessel to the production unit. Further, existing wells can also be connected to the large production unit. A new mooring system will have to be installed for the large production vessel.

In combination with any of the scenarios listed above, additional reservoir needs may be identified during the course of production, such as the need for additional water, gas, or chemical injection, or any variety of equipment. In this case, this additional equipment can either be added to the existing facility or it could be deployed on a new small unit, similar in size to that noted above as the small production vessel. Since this equipment can be added later, it does not need to be designed into the initial development plan, therefore deferring capital requirements until the information is available.

The skilled practitioner will note that the flexible components and technologies that interact in this system can be used in a wide variety of ways to adjust to evolving reservoir understanding and that they are capable of addressing nearly all practical applications that are found in deepwater field development with relative ease. The system as presented is therefore a flexible, extensible architecture for field development that allows modification of the existing decision making paradigm. The methods described herein provide a separation of the design of the equipment that is on the seafloor and the equipment that is on the surface. It is therefore much simpler to contemplate the redeployment of the facility as well as the replacement of the initial facility with a more appropriate unit.

The preferred embodiments of the present invention relate to apparatus for the development of offshore oil and gas fields. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A method comprising:

drilling and completing at least one well in an offshore field with a lead drilling and production vessel;

initiating production from the at least one well before formulating an initial plan for the development of the offshore field that identifies a number of wells to be drilled in the offshore field and a location of each of the wells to be drilled in the offshore field;

evaluating production from the at least one well after said step of initiating production;

selecting a secondary production vessel based upon the evaluated production from the at least one well; and deploying the secondary production vessel to the offshore field so as to replace the lead drilling and production vessel and support production of the at least one well.

2. The method of claim 1, wherein the secondary production vessel comprises at least one modular topsides component selected from the list consisting of a utility module, a power module, a production module, a quarters module, and a drilling module.

3. The method of claim 2, wherein the modular topsides component is selected based on the evaluated production from the at least one well.

4. The method of claim 1, further comprising deploying a modular export system that allows the secondary production vessel to replace the lead drilling and production vessel without replacing the modular export system.

5. The method of claim 1, wherein the lead drilling and production vessel comprises surface pressure control equipment.

6. The method of claim 1 further comprising:

drilling and completing a plurality of wells from the secondary production vessel;

evaluating the production from the plurality of wells; and deploying a follow-on production vessel to the offshore field to replace the secondary production vessel and support production from the plurality of wells.

7. The method of claim 6, further comprising deploying a modular export system that allows the follow-on production vessel to replace the secondary production vessel without replacing any subsea equipment.

8. The method of claim 6, further comprising relocating the secondary production vessel to another offshore field.

9. The method of claim 1 further comprising deploying a mooring system that can remain in place if a vessel is moved and can be used for another vessel deployed to the offshore field.

10. The method of claim 1 further comprising:

deploying a modular export system to the seafloor; and coupling the at least one well to the modular export system.

11. The method of claim 10, further comprising coupling an existing well to the modular export system, wherein the existing well was not drilled by the lead drilling and production vessel or the secondary production vessel.

12. The method of claim 1 further comprising deploying a vertical riser to support production from the at least one well.

13. The method of claim 1 further comprising deploying an installation vessel to the offshore field, wherein the installation vessel is operable to install mooring lines, anchors, offshore tiebacks, modular export systems, flowlines, jumpers, and other non-drilling related subsea tasks.

14. The method of claim 1, further comprising coupling the secondary production vessel to an existing well that was not drilled by the lead drilling and production vessel or the secondary production vessel.

15. A method comprising:

drilling and completing a first well in an offshore field, wherein the first well is drilled and completed from a lead drilling and production vessel;

producing the first well using the lead drilling and production vessel;

evaluating production from the first well after said step of producing;

using the evaluation of production from the first well to formulate an initial plan for the development of the offshore field, wherein the initial plan includes an identification of a number of wells to be drilled in the offshore field and a location of each of the wells to be drilled in the offshore field; and developing the offshore field utilizing a secondary production vessel selected in accordance with the initial plan for development of the offshore field.

16. The method of claim 15, wherein the secondary production vessel comprises at least one modular topsides component selected from the list consisting of a utility module, a power module, a production module, a quarters module, and a drilling module.

17. The method of claim 16, wherein the modular topsides component is selected based on the evaluated production from the at least one well.

18. The method of claim 15, further comprising deploying a modular export system that allows the secondary production vessel to replace the lead drilling and production vessel without replacing the modular export system.

19. The method of claim 15, wherein the lead drilling and production vessel comprises surface pressure control equipment.

20. The method of claim 15 further comprising:

drilling and completing a plurality of wells from the secondary production vessel;

evaluating the production from the plurality of wells; and deploying a follow-on production vessel to the offshore field to replace the secondary production vessel and support production from the plurality of wells.

21. The method of claim 20, further comprising deploying a modular export system that allows the follow-on production vessel to replace the secondary production vessel without replacing any subsea equipment.

22. The method of claim 20, further comprising relocating the secondary production vessel to another offshore field.

23. The method of claim 15 further comprising deploying a mooring system that can remain in place if a vessel is moved and can be used for another vessel deployed to the offshore field.

24. The method of claim 15 further comprising:

deploying a modular export system to the seafloor; and coupling the at least one well to the modular export system.

25. The method of claim 24, further comprising coupling an existing well to the modular export system, wherein the existing well was not drilled by the lead drilling and production vessel or the secondary production vessel.

26. The method of claim 15 further comprising deploying a vertical riser to support production from the at least one well.

27. The method of claim 15 further comprising deploying an installation vessel to the offshore field, wherein the installation vessel is operable to install mooring lines, anchors, offshore tiebacks, modular export systems, flowlines, jumpers, and other non-drilling related subsea tasks.

28. The method of claim 15, further comprising coupling the secondary production vessel to an existing well that was not drilled by the lead drilling and production vessel or the secondary production vessel.

29. A method comprising:

initiating production from a first well in an offshore field;

formulating an initial plan for the development of the offshore field by evaluating the production from the first well after said step of initiating production, wherein the initial plan includes a selection of an export means to be employed at the offshore field; and developing the offshore field utilizing a modular production vessel having a configuration selected in accordance with the initial plan, wherein the configuration of the modular production vessel can change during the development of the offshore field.

30. The method of claim 29, wherein the modular production vessel comprises at least one modular topsides component selected from the list consisting of a utility module, a power module, a production module, a quarters module, and a drilling module.

31. The method of claim 30, wherein the modular topsides component is selected based on the evaluated production from the at least one well.

32. The method of claim 29, further comprising deploying an installation vessel to the offshore field, wherein the installation vessel is operable to install mooring lines, anchors, offshore tiebacks, modular export systems, flowlines, jumpers, and other non-drilling related subsea tasks.

33. The method of claim 29, further comprising coupling a secondary production vessel to an existing well that was not drilled by the modular production vessel or the secondary production vessel.

* * * * *